US009596542B2

(12) United States Patent
Lee et al.

(10) Patent No.: US 9,596,542 B2
(45) Date of Patent: Mar. 14, 2017

(54) APPARATUS AND METHOD WITH ENHANCEMENT OF SOUND QUALITY

(71) Applicant: SAMSUNG ELECTRONICS CO., LTD., Suwon (KR)

(72) Inventors: Kang Eun Lee, Hwaseong (KR); Do Hyung Kim, Hwaseong (KR); Shi Hwa Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 656 days.

(21) Appl. No.: 13/856,640

(22) Filed: Apr. 4, 2013

(65) Prior Publication Data

US 2013/0272529 A1 Oct. 17, 2013

(30) Foreign Application Priority Data

Apr. 16, 2012 (KR) ..... 10-2012-0039223

(51) Int. Cl.
*H04R 3/04* (2006.01)

(52) U.S. Cl.
CPC ..... *H04R 3/04* (2013.01); *H04R 2430/03* (2013.01)

(58) Field of Classification Search
CPC ..... G10L 21/038; G10L 21/0388; G10L 19/0208; G10L 19/008; G10L 19/0204; G10L 19/24; G10L 25/21; G10L 25/18; H04R 3/04; H04R 2430/03
USPC ..... 381/98–100, 22, 23, 56, 61; 700/94; 704/219, 225, 230, 262, 269, 500, 704/E19.001
See application file for complete search history.

(56) References Cited

U.S. PATENT DOCUMENTS

| | | | | |
|---|---|---|---|---|
| 2004/0131203 | A1* | 7/2004 | Liljeryd et al. | 381/98 |
| 2007/0216546 | A1 | 9/2007 | Iwasaki et al. | |
| 2007/0296614 | A1* | 12/2007 | Lee et al. | 341/50 |
| 2008/0129350 | A1* | 6/2008 | Mitsufuji et al. | 327/113 |

FOREIGN PATENT DOCUMENTS

| | | |
|---|---|---|
| JP | 9-23127 | 1/1997 |
| JP | 2002-175092 | 6/2002 |
| JP | 2007-101871 | 4/2007 |
| JP | 2008-158301 | 7/2008 |
| JP | 2009-294501 | 12/2009 |
| JP | 2009-300707 | 12/2009 |
| JP | 2010-20251 | 1/2010 |
| KR | 10-2005-0037431 | 4/2005 |
| KR | 10-2006-0012783 | 2/2006 |
| KR | 10-2010-0095585 | 5/2010 |
| KR | 10-2010-0062063 | 6/2010 |

OTHER PUBLICATIONS

Japanese Office Action dated Jan. 4, 2017 in Japanese Patent Application No. 2013-084883.

* cited by examiner

*Primary Examiner* — David Ton
(74) *Attorney, Agent, or Firm* — Staas & Halsey LLP

(57) ABSTRACT

An audio processing apparatus and method are provided. The audio processing apparatus includes an envelope detector to detect an envelope of an input signal with respect to a low frequency band, and a signal restorer to restore the input signal including a high frequency band by performing frequency folding of frequency sub-band according the envelope.

31 Claims, 11 Drawing Sheets

<A> First folding method

<B> Second folding method

APPARATUS AND METHOD WITH ENHANCEMENT OF SOUND QUALITY

CROSS-REFERENCE TO RELATED APPLICATIONS

This application claims the benefit of Korean Patent Application No. 10-2012-0039223, filed on Apr. 16, 2012, in the Korean Intellectual Property Office, the disclosure of which is incorporated herein by reference.

BACKGROUND

1. Field

One or more embodiments of the following description relate to an apparatus and method restoring signals corresponding to a frequency band of an input signal using signals corresponding to another frequency band of the input signal.

2. Description of the Related Art

Recently, audio contents are expressed and stored usually by being compressed using a coding scheme such as moving picture expert group (MPEG) audio layer 3 (MP3) and windows media audio (WMA). Such coding schemes use a psychoacoustic model representing audibility characteristics of a human in different frequency regions. Here, these conventional coding schemes may not code high frequency components, e.g., high frequencies that are almost inaudible to human ears, to prevent deterioration of sound quality while increasing coding efficiency. In addition, although the original sound source may not be compressed with a low bit rate, a high frequency band of the sound source may not be encoded at all due to a low sampling rate.

In this case, a signal of the high frequency band may need to be restored by a frequency band expansion scheme. Here, the expansion scheme merely shifts a signal of a low frequency band to the high frequency band along a frequency axis.

According to related arts, in this case, discontinuity may be generated at a cutoff frequency, which forms a boundary between the low frequency band and the high frequency band. Furthermore, when the signal of the low frequency band is simply frequency shifted to represent the signal of the high frequency band, because an original envelope for the high frequency band actually has different characteristics compared to an envelope for the low frequency band, an error may occur in the signal of the restored high frequency band.

Thus, low sound quality may be derived even after the signal of the high frequency band is restored.

SUMMARY

One or more embodiments include an audio processing apparatus including an envelope detector to detect an envelope of an input signal with respect to a low frequency band of the input signal, and a signal restorer to restore a high frequency band of the input signal by performing frequency folding in frequency sub-band units according to the envelope.

One or more embodiments include an audio processing apparatus including an envelope detector to detect an envelope of an input signal with respect to a low frequency band of the input signal, a signal restorer to restore a high frequency band of the input signal using a detected envelope of a sub-band of the low frequency band, adjacent to a cutoff frequency, from the detected envelope of the input signal, and an envelope adjuster to adjust an envelope of the high frequency band by considering a tilt of the envelope of the low frequency band.

One or more embodiments include an audio processing method including detecting an envelope of an input signal with respect to a low frequency band of the input signal, and restoring a high frequency band of the input signal by performing frequency folding in frequency sub-band units according to the envelope.

One or more embodiments include an audio processing method including detecting an envelope of an input signal with respect to a low frequency band of the input signal, restoring a high frequency band of the input signal using a detected envelope of a sub-band of a low frequency band, adjacent to a cutoff frequency, from the detected envelope of the input signal, adjusting an envelope of the high frequency band by considering a tilt of the envelope of the low frequency band.

Additional aspects, features, and/or advantages of one or more embodiments will be set forth in part in the description which follows and, in part, will be apparent from the description, or may be learned by practice of the disclosure.

BRIEF DESCRIPTION OF THE DRAWINGS

These and/or other aspects and advantages will become apparent and more readily appreciated from the following description of the one or more embodiments, taken in conjunction with the accompanying drawings of which.

DETAILED DESCRIPTION

Figure 1:
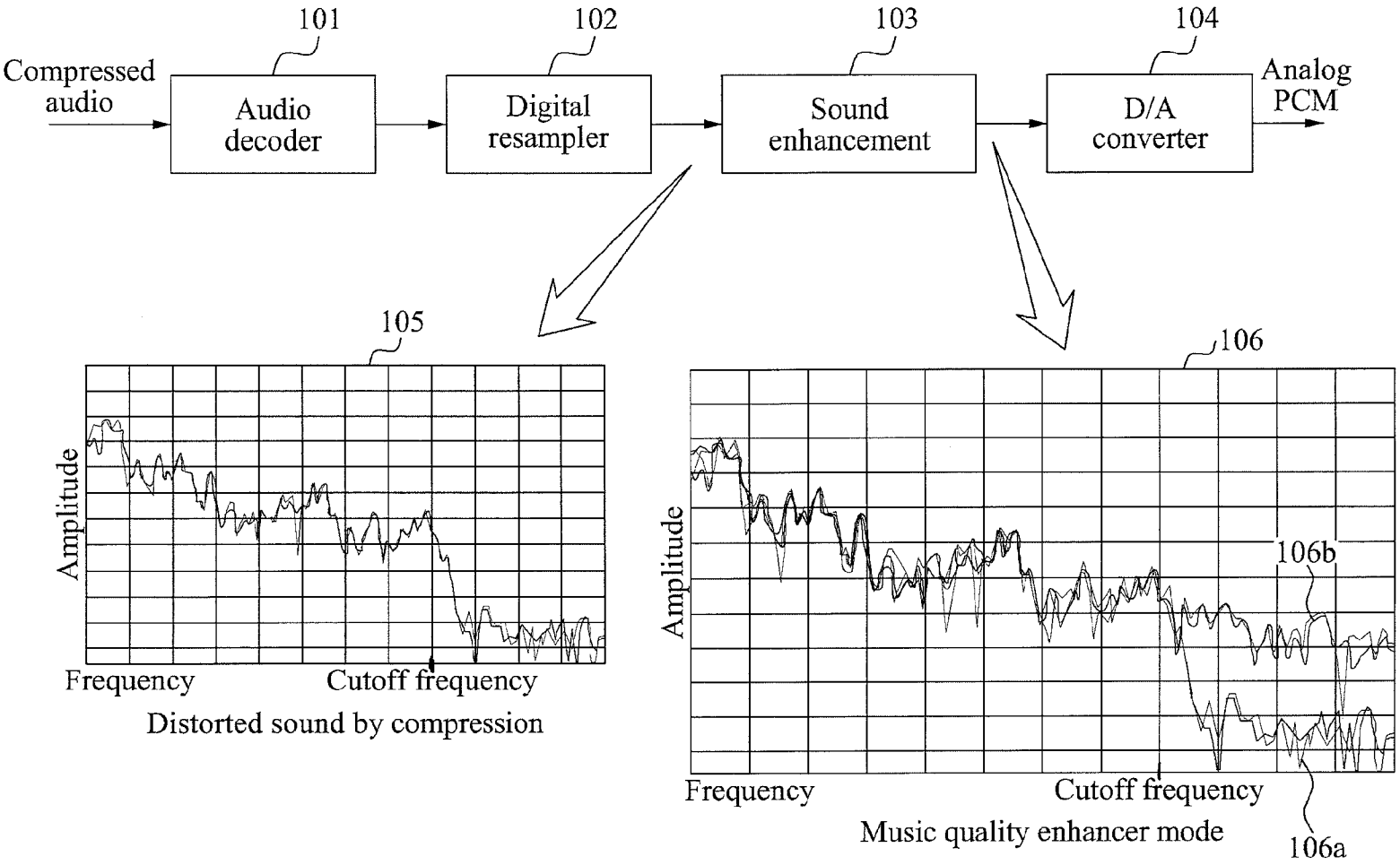
FIG. 1 illustrates an audio processing apparatus, according to one or more embodiments.

Reference will now be made in detail to one or more embodiments, illustrated in the accompanying drawings, wherein like reference numerals refer to like elements throughout. In this regard, embodiments of the present invention may be embodied in many different forms and should not be construed as being limited to embodiments set forth herein. Accordingly, embodiments are merely described below, by referring to the figures, to explain aspects of the present invention.

FIG. 1 illustrates an audio processing apparatus, according to one or more embodiments.

In one or more embodiments, audio data compressed by a low bit rate or low sampling rate, for example, may be restored through an audio decoder 101. Here, the compressed audio may represent only a low frequency band signal or an audio signal for only a low frequency band of an original wide frequency band, such as a low frequency band of the original wide frequency band where only the low frequency band (i.e., not the corresponding high frequency band) was encoded into the compressed audio. Alternatively, the compressed audio may represent a wide band signal, e.g., a wide band signal with mostly low frequency information, or merely only represent an audio signal that represents at least low frequencies. Next, the decompressed audio signal may be provided to a digital resampler 102, which may resample the decompressed audio signal. Next, a sound quality enhancement apparatus 103 may restore a signal of a high frequency band from the signal output by the digital resampler 102. The resampled signal may then represent a signal with only decoded low frequencies, i.e., frequencies up to or including a cut-off frequency, or a wider signal that represents the decoded low frequencies and ancillary signal information in the high frequency band, i.e., frequencies at or above the cut-off frequency. This ancillary signal information could be a result of the resampler and/or of high frequency information that existed in the decoded signal before being resampled.

The graph 105 represents an original signal and the decoded input signal or a resampling of the input signal. As shown in graph 105, the signal information drops off substantially at the cut-off frequency, so the graph 105 primarily represents only the low frequency band. In one or more embodiments, the illustrated ancillary high frequency information in graph 105 may be filtered out before further recovery of a high frequency band from the low frequency band. The graph 106 represents the low frequency band and the restored high frequency band. Here, for explanatory purposes, graph 106 also demonstrates the ancillary high frequency information 106*a* also shown in graph 105, e.g., which may actually be filtered out before restoration of the high frequency band, as well as the restored high frequency band signal 106*b*. The restored output signal may then be finally output through a digital-analog (D/A) converter 104.

Figure 2:
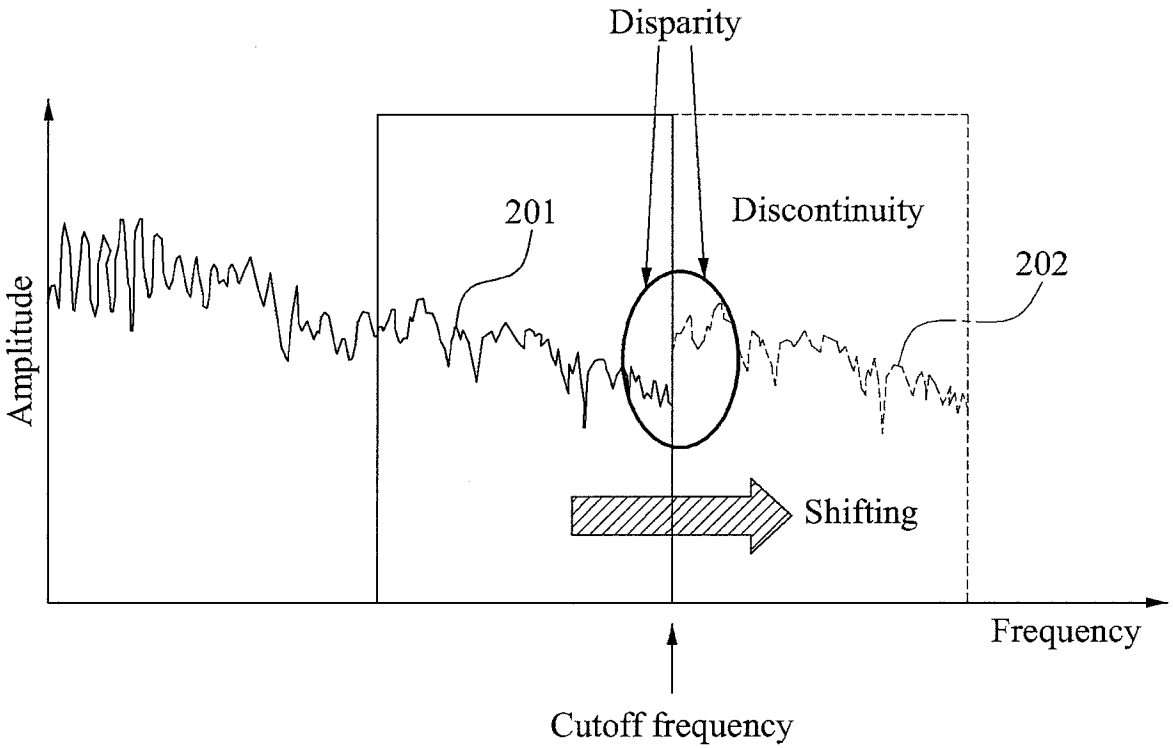
FIG. 2 illustrates a discontinuity occurring around a cutoff frequency, according to one or more embodiments.

FIG. 2 illustrates a discontinuity around a cutoff frequency, according to one or more embodiments.

As shown in FIG. 2, when a sub-band signal 201 of a low frequency band is simply frequency shifted with reference to the cutoff frequency to restore a sub-band signal 202 of the high frequency band, an audible discontinuity may occur around the cutoff frequency. Here, as noted, the cutoff frequency may be a boundary frequency or brief range of frequencies between the low frequency band and the high frequency band. Human beings are more apt to hear a signal of the low frequency band than a signal of the high frequency band. Therefore, the signal of the low frequency band may need to be more precisely restored than the signal of the high frequency band, which may be demonstrated by restoring the high frequency band from the low frequency band rather than needing decompressed high frequency band information, as only an example.

However, when the signal of the low frequency band is shifted simply with reference to the cutoff frequency, a signal at a lowest frequency band out of the restored high frequency band may not be sufficiently similar to an original high frequency signal.

Figure 3:
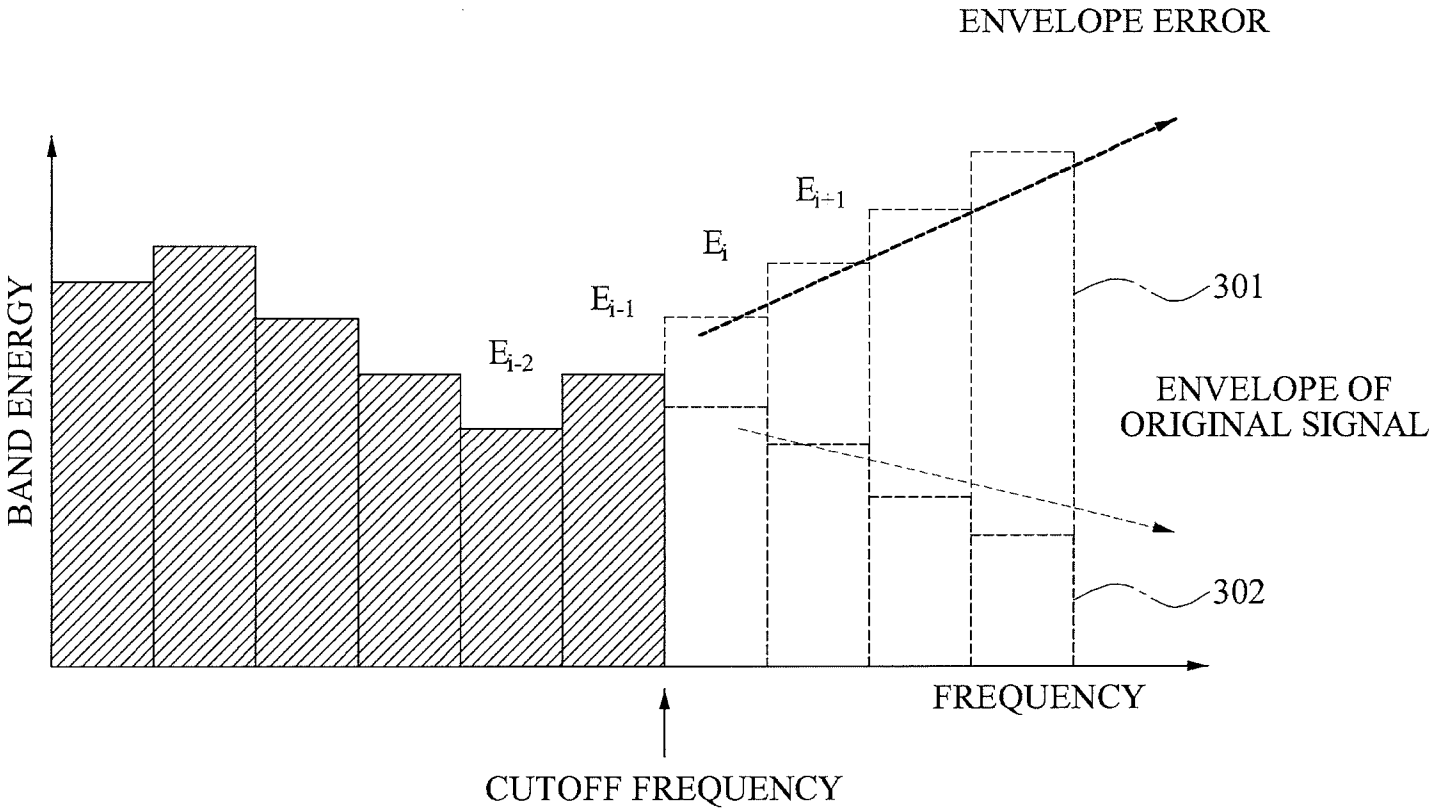
FIG. 3 illustrates a process of adjusting an envelope of a high frequency band, according to one or more embodiments.

FIG. 3 illustrates a process of adjusting an envelope of a high frequency band, according to one or more embodiments.

Conventionally, when an envelope of a restored high frequency band is adjusted using a tilt of an envelope corresponding to two low frequency sub-bands $E_{i-2}$ and $E_{i-1}$ located closest to a cutoff frequency, an error may be caused as shown in FIG. 3. That is, when relations between the low frequency sub-bands $E_{i-2}$ and $E_{i-1}$ are exceptional, an error may occur. For example, an envelope 301 derived only from the low frequency sub-bands $E_{i-2}$ and $E_{i-1}$ may be different from an original envelope 302 of the original high frequency band or an envelope 302 derived from additional sub-bands of the low frequency sub-bands. Sound quality may be reduced due to the error.

One or more embodiments introduce a method of restoring a signal to be as similar to an original signal as possible, e.g., by minimizing such errors shown in FIGS. 2 and 3.

Figure 4:
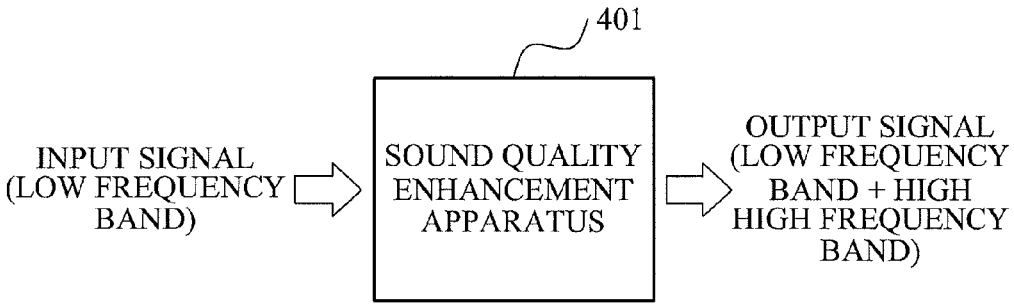
FIG. 4 illustrates a sound quality enhancement apparatus, according to one or more embodiments.

FIG. 4 illustrates a sound quality enhancement apparatus, according to one or more embodiments.

Referring to FIG. 4, a sound quality enhancement apparatus 401 may generate a signal having a decoded low frequency band and restored high frequency band derived from the decoded low frequency band. Here, in one or more embodiments, the decoded low frequency band, without high frequency information, may be forwarded to the sound quality enhancement apparatus 401, where the sound quality enhancement apparatus 401 may restore the signal of the high frequency band based on the signal of the low frequency band.

Figure 5:
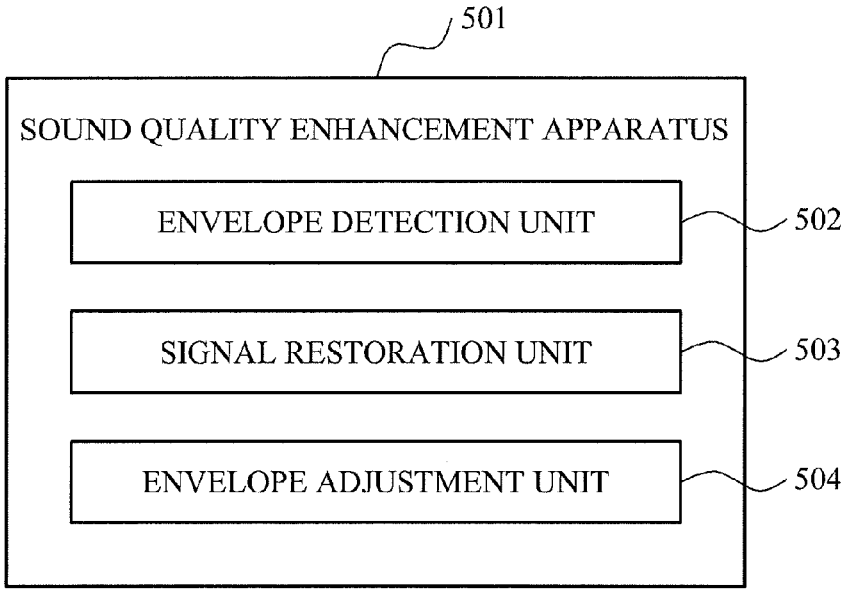
FIG. 5 illustrates components of the sound quality enhancement apparatus, according to one or more embodiments.

FIG. 5 illustrates components of the sound quality enhancement apparatus 501, according to one or more embodiments.

Referring to FIG. 5, the sound quality enhancement apparatus 501 may include an envelope detector 502, a signal restorer 503, and an envelope adjuster 504, for example.

The envelope detector 502 may detect an envelope of a low frequency band signal, e.g., the decoded or resampled low frequency band signal. As only an example, the envelope detector 502 may extract the envelope of the low frequency band signal using a determined energy per frequency sub-band of the low frequency band signal. Here, the envelope detector 502 may further perform flattening with respect to an envelope change degree by smoothing a tilt of the envelope from the low frequency band to be applied to the high frequency band, along a time axis.

The signal restorer 503 may restore the input signal of the high frequency band using a detected envelope of a sub-band of the low frequency band adjacent to the cutoff frequency. As only an example, the signal restorer 503 may restore the input signal of the high frequency band by performing frequency folding, i.e., mirror imaging a signal or a sub-band portion of the signal so low and high frequencies are transposed about a frequency, in units of a frequency sub-band along the envelope for the high frequency band. That is, the signal restorer 503 may generate a signal corresponding to a current frequency sub-band for the high frequency band by folding, i.e., mirror imaging, the signal corresponding to a frequency-wise previous frequency sub-band. Here, when the current frequency sub-band is a first frequency sub-band of the high frequency band, the signal restorer 503 may generate the signal corresponding to the current frequency sub-band by folding the signal corresponding to the previous low frequency sub-band. In addition, the signal restorer 503 may perform flattening of an envelope corresponding to the current frequency sub-band by considering whether an envelope corresponding to the previous generated frequency sub-band is flat.

Accordingly, in one or more embodiments, the envelope adjuster 504 may adjust an envelope corresponding to the restored high frequency band by considering a tilt of the envelope corresponding to the low frequency band of the input signal.

Figure 6:
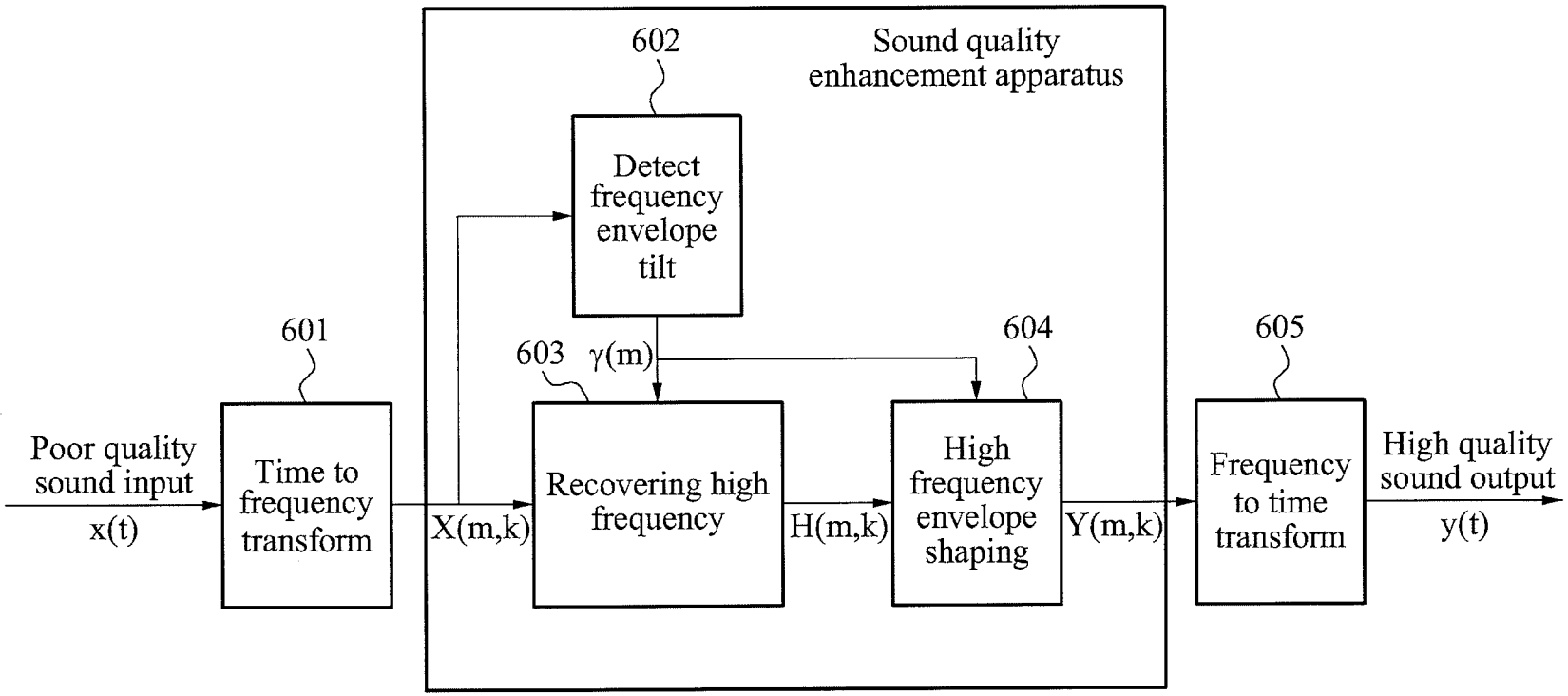
FIG. 6 illustrates an audio processing apparatus, according to one or more embodiments.

FIG. 6 illustrates an audio processing apparatus, according to one or more embodiments.

In one or more embodiments, an input signal x(t) of a time domain may be transformed to an input signal X(m,k) of a frequency domain by the time to frequency transformer 601. Here, x(t) refers to the input signal, e.g., a low frequency band signal. Enhancement of sound quality may be performed in sub-band units of a frame. Here, m may denote a frame index and k may denote a frequency index. The input signal transformed to the frequency domain signal may be input to the sound quality enhancement apparatus.

Energy values per frequency sub-band of a low frequency band in the input signal X(m,k) may be determined by the frequency envelope tilt detector 602. Next, the frequency envelope tilt detector 602 may deduce a tilt γ(m) of an envelope corresponding to the low frequency band, using the determined sub-band energy values.

A high frequency band signal may be restored by the high frequency recoverer 603. In one or more embodiments, the high frequency recoverer 603 may restore one or more sub-bands of the high frequency band by folding one or more sub-band signals of the low frequency band into the high frequency band with reference to a cutoff frequency. In one or more embodiments, a first sub-band of the high frequency band may be restored based upon a folding or mirroring of an adjacent sub-band signal of the low frequency band, e.g., mirroring the sub-band signal of the low frequency band at the cut-off frequency onto the first sub-band of the high frequency band. Here, the high frequency recoverer 603 may flatten the envelope, e.g., of the low frequency sub-band to be folded, for application to the first sub-band of the high frequency band. In one or more embodiments, the envelope of the first sub-band of the high frequency band may not be flattened if the envelope of the low frequency sub-band used in the folding was already flattened.

Next, the high frequency recoverer 603 may restore each sub-band signal corresponding to the high frequency band by sequentially folding a respectively previous restored sub-band signal of the high frequency band into a current to-be-restored sub-band of the high frequency band.

The envelope of the restored high frequency band may further be adjusted by a high frequency envelope shaper 604, based on a tilt of the envelope of the low frequency band, such as deduced by the frequency envelope tilt detector 602. A frequency to time transformer 605 may then frequency transform a signal Y(m,k) of a final frequency domain to a signal of a time domain, accordingly generating an output signal y(t). The output signal y(t), which includes the signal of the low frequency band and the restored signal of the high frequency band, may have higher clarity and more ample sound quality than the input signal x(t) that may not have included high frequency band information.

Figure 7:
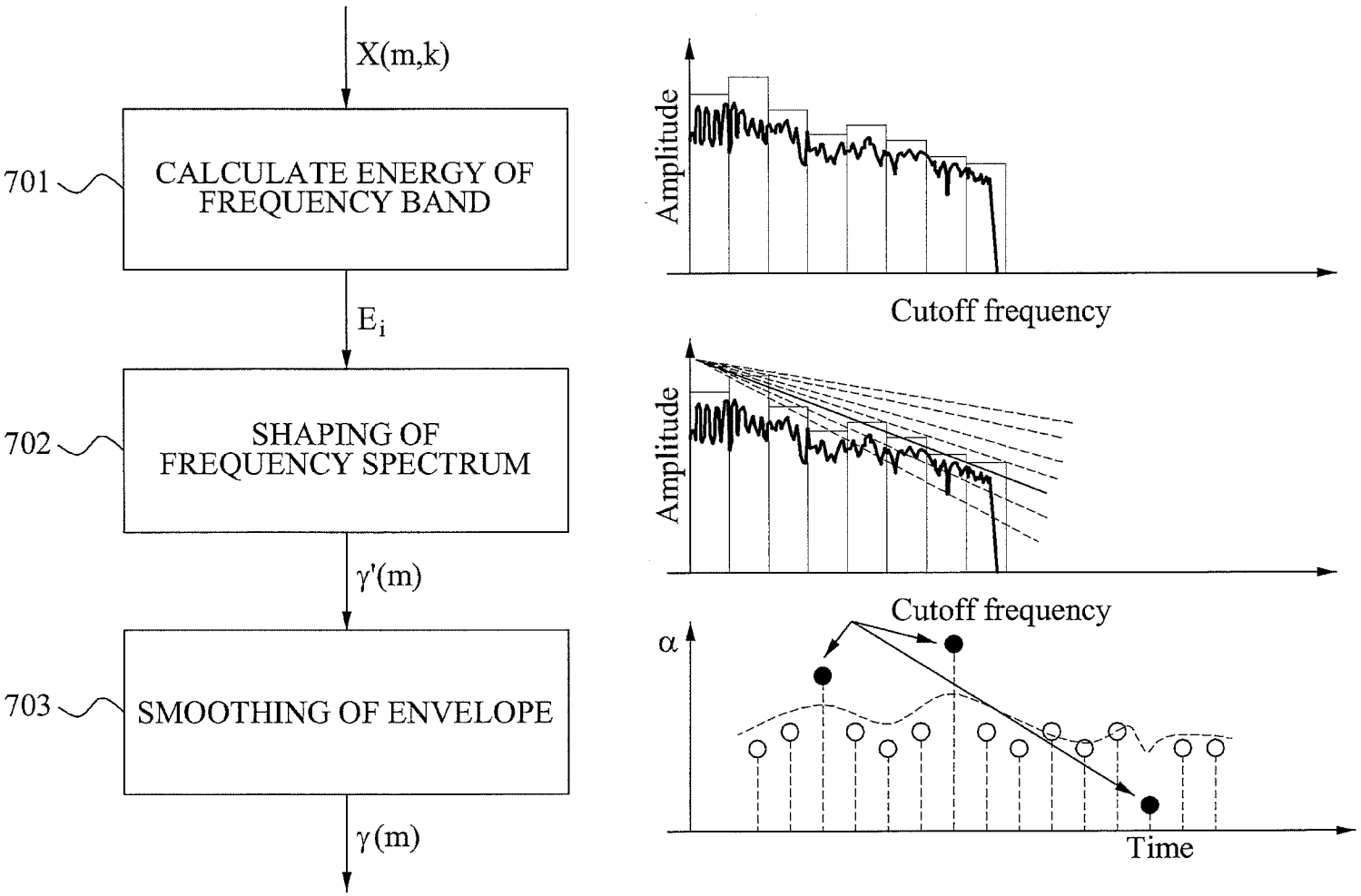
FIG. 7 illustrates a process of detecting an envelope with respect to a low frequency band, according to one or more embodiments.

FIG. 7 illustrates a process of detecting an envelope with respect to a low frequency band, according to one or more embodiments.

In operation 701, energy Ei per frequency sub-band, corresponding to a low frequency band in the input signal X(m,k), may be calculated. The low frequency band may be divided into an I-number of low frequency sub-bands.

As only an example, the energy per frequency sub-band may be calculated using the below Equation 1.

$$E_i = \sqrt{\sum_{l=f_i}^{f_{i+1}-1} X(m, l)X^*(m, l)} \qquad \text{Equation 1}$$

Here, Ei denotes the calculated energy corresponding to the i-th frequency sub-band, i denotes such an index of the frequency sub-band, fi denotes an index of a starting frequency in the i-th frequency sub-band, and * denotes a conjugate complex number.

In operation 702, a tilt of the envelope corresponding to the low frequency band may be calculated using the respective energies per frequency sub-band based on the below Equation 2, as only an example.

$$V_n(\alpha) = \exp\left(-\frac{\alpha n}{2I}\right), \quad n = 0, \ldots, I-1 \qquad \text{Equation 2}$$

Here, Vn(α) denote the envelope, a denotes a tilt of the envelope, and I denotes a number of low frequency sub-bands.

In order to deduce a tilt of a most similar envelope with respect to an actual envelope of the low frequency band, an error may be determined between the envelope and the tilt using the below Equation 3, as only an example.

$$\mathrm{Err}(\alpha) = \sum_{n=0}^{I-1} (E_n - V_n(\alpha)\max(E_i))^2, \quad i = 0, \ldots, I-1, \alpha = 1, \ldots, A \qquad \text{Equation 3}$$

Here, Err(α) denotes an error between the envelope of the low frequency band and the envelope of the low frequency band based on the tilt. A denotes a maximum tilt candidate value related to the envelope. A tilt γ'(m) that minimizes the error between the envelope of the low frequency band and the envelope of the low frequency band based on the tilt, in the frame m, may be calculated using Equation 4, again as only an example. The tilt γ'(m) may need smoothing so that noise generated by a sudden change in the time domain is reduced.

Accordingly, in operation 703, smoothing of the envelope may be performed. As only an example, the smoothing may be performed using the below Equation 4, as only an example.

$$\gamma(m)=\beta\gamma'(m)+(1-\beta)\gamma(m-1) \qquad \text{Equation 4:}$$

Thus, the smoothing of the envelope may be performed by combining a tilt of a previous frame and a tilt of a current frame, resulting in the tilt γ(m) of a final envelope. That is, flattening with respect to an envelope change may be performed by smoothing the tilt of the envelope along a time axis. Here, b denotes a combination coefficient indicating a degree of reflecting the tilt of the envelope to the final envelope, and m corresponds to the current frame and m−1 corresponds to the previous frame.

When b approximates 1, the tilt γ(m) of the final envelope may be determined to be the tilt of the current frame. When b approximates 0, the tilt γ(m) of the final envelope may be determined to be the tilt of the previous frame, as only examples.

Figure 8:
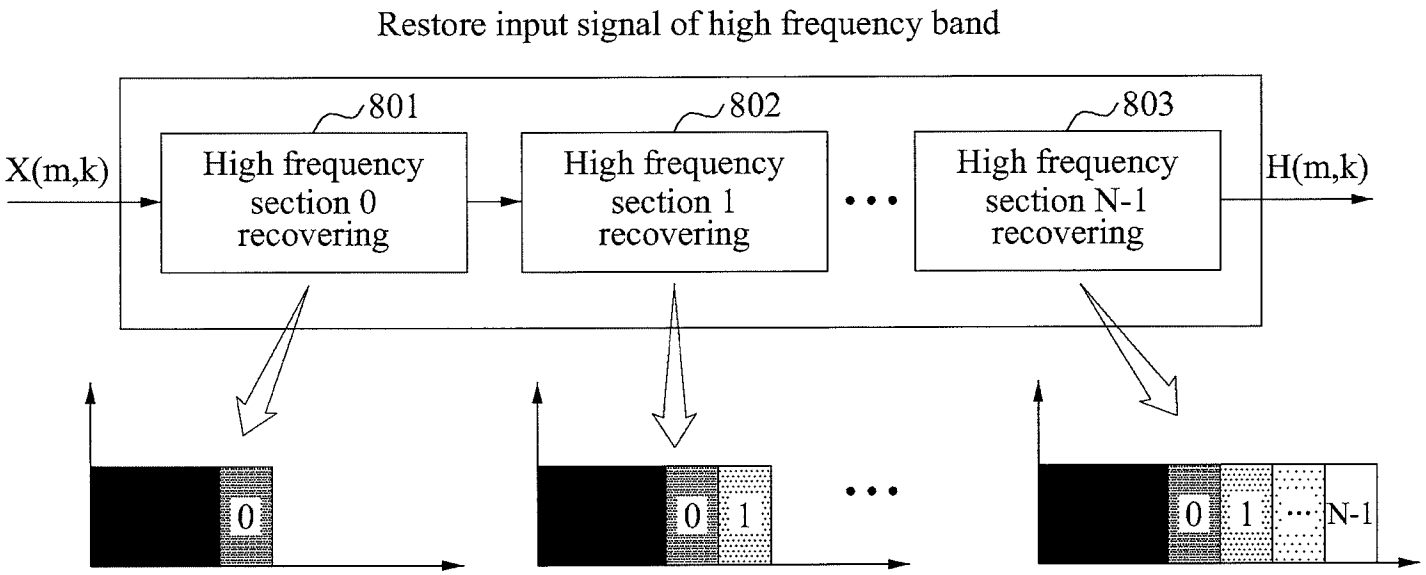
FIG. 8 illustrates a process of restoring signals of a high frequency band, according to one or more embodiments.

FIG. 8 illustrates a process of restoring a signal of a high frequency band, according to one or more embodiments.

As shown in FIG. 8, the high frequency band may be divided into an N-number of unitary high frequency sub-bands. The signal of the high frequency band may be restored for every respective unitary frequency sub-band. Here, the signal of the high frequency band may be restored by folding a signal corresponding to a previous frequency sub-band in an order from low frequencies to high frequencies of the high frequency band. Regarding a frequency sub-band located in a first position of the high frequency band, e.g., a lowest frequency sub-band of the high frequency band, a signal corresponding to the first frequency sub-band of the high frequency band may be restored by folding a signal of a sub-band of the low frequency band, i.e., a sub-band located before the cutoff frequency.

Using the method illustrated in FIG. 8, noise potentially generated by a strong harmonic signal of the low frequency band, e.g., if the entire signal of the low frequency band were to be folded into the high frequency band, may be reduced.

Figure 9:
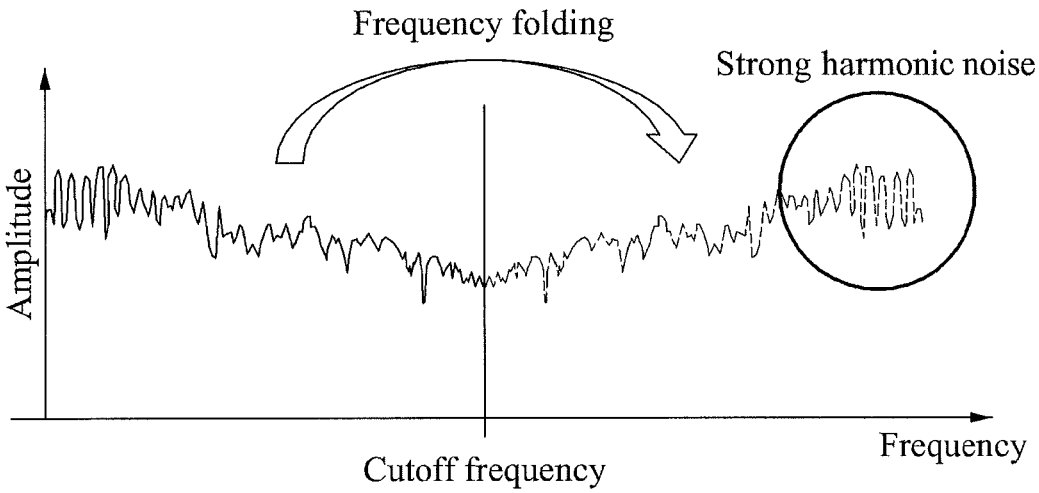
FIG. 9 illustrates a result of a comparing of a first folding approach and a second folding approach, according to one or more embodiments.
Figure 9:
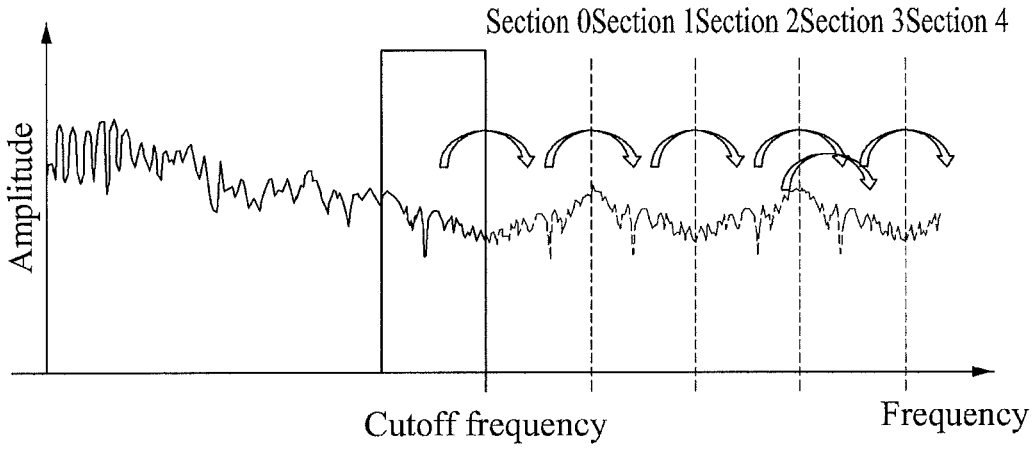

FIG. 9 illustrates a result of comparing a first folding approach and a second folding approach, according to one or more embodiments.

According to a first folding approach, the entire signal of a low frequency band may be folded into the high frequency band with respect to the cutoff frequency, i.e., the sub-bands of the low frequency band will be reflected about the cutoff frequency into the high frequency band. According to a second folding approach, a signal for the high frequency band may be sequentially folded into the high frequency band in frequency sub-band units. A signal corresponding to a frequency sub-band 0 (or section 0) of the high frequency band, e.g., the first sub-band of the high frequency band adjacent to the cutoff frequency, may be restored by partially folding the signal of the low frequency band before the cutoff frequency. For example, the last sub-band of the low frequency band before the cutoff frequency may be folded into the first sub-band frequency of the high frequency band. A signal corresponding to a frequency sub-band 1 (or section 1) of the high frequency band may be restored by folding the just restored signal corresponding to the frequency sub-band 0 into the frequency sub-band 1 of the high frequency band. In this manner, signals of the high frequency band may be restored from the frequency sub-band 1 to a frequency sub-band N (or section N) with respect to a respective previously restored sub-band of the high frequency band.

According to the first folding approach, a strong harmonic noise from the low frequency band may be unavoidably included in the restored high frequency band. However, according to the second folding approach, such harmonic noise of the low frequency band would not be included in the high frequency band, thereby avoiding the reduction in sound quality caused by the low frequency band harmonic noise.

Figure 10:
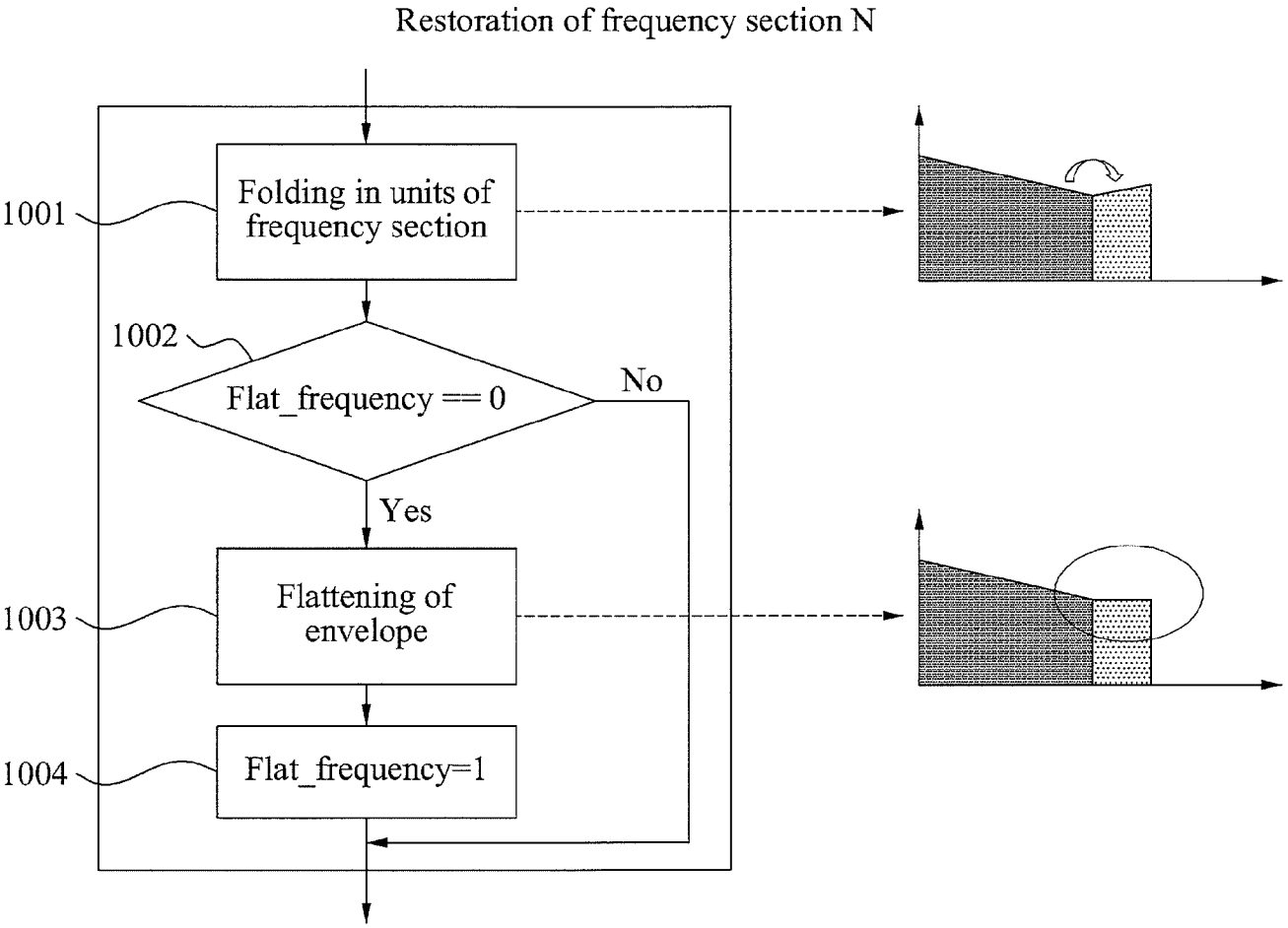
FIG. 10 illustrates a process of flattening an envelope of a high frequency band, according to one or more embodiments.

FIG. 10 illustrates a process of flattening an envelope of a high frequency band, according to one or more embodiments.

In FIG. 10, presuming that fn denotes a starting frequency index of an n-th frequency sub-band, a final frequency index may be fn+1−1. A starting frequency index of a frequency sub-band 0 becomes a cutoff frequency which is a first frequency index of the high frequency band to be restored.

In operation 1001, the folding in of the frequency sub-band units into the high frequency band may be performed. Here, a signal corresponding to a current frequency sub-band may be restored by folding a signal corresponding to a previous frequency sub-band. The signal folding process may be expressed by using the below Equation 5, as only an example.

$$X(m,f_n+k)=X(m,f_n+k)+X(m,f_n-k-1),\ k=0,\ldots f_{n+1}-f_n \qquad \text{Equation 5:}$$

Here, fn denotes an n-th frequency.

In operation 1002, there may be a determination as to whether a flat_frequency indicator is 0. The flat_frequency indicator may be controlled to indicate whether an envelope corresponding to a previous frequency sub-band has been flattened. When the flat_frequency indicator is 0, the envelope of the previous frequency sub-band may not have been flattened. When the flat_frequency indicator is 1, the envelope of the previous frequency band may have already been flattened.

Therefore, when the flat_frequency indicator is 0, flattening of the envelope of a current frequency sub-band may be performed in operation 1003. The flattening may be performed using the below Equation 6, as only an example.

$$X(m,f_n+k)=X(m,f_n+k)v_k(\gamma),\ k=0,\ldots f_{n+1}-f_n \qquad \text{Equation 6:}$$

Here, vk denotes an envelope generated based on an optimal tilt of the envelope of the low frequency band. In one or more embodiments, mostly, the flattening of the envelope may be performed in a first frequency sub-band with respect to the high frequency band, rather than subsequent frequency sub-bands of the high frequency band.

In operation 1004, when such flattening is performed the flat_frequency indicator may be changed to 1 so that flattening is not redundantly performed in subsequent frequency sub-bands of the high frequency band. When the flat_frequency indicator is 1, in operation 1002, the sound quality enhancement process may just end without performing any further operation after the folding in of the remaining frequency sub-band units.

Figure 11:
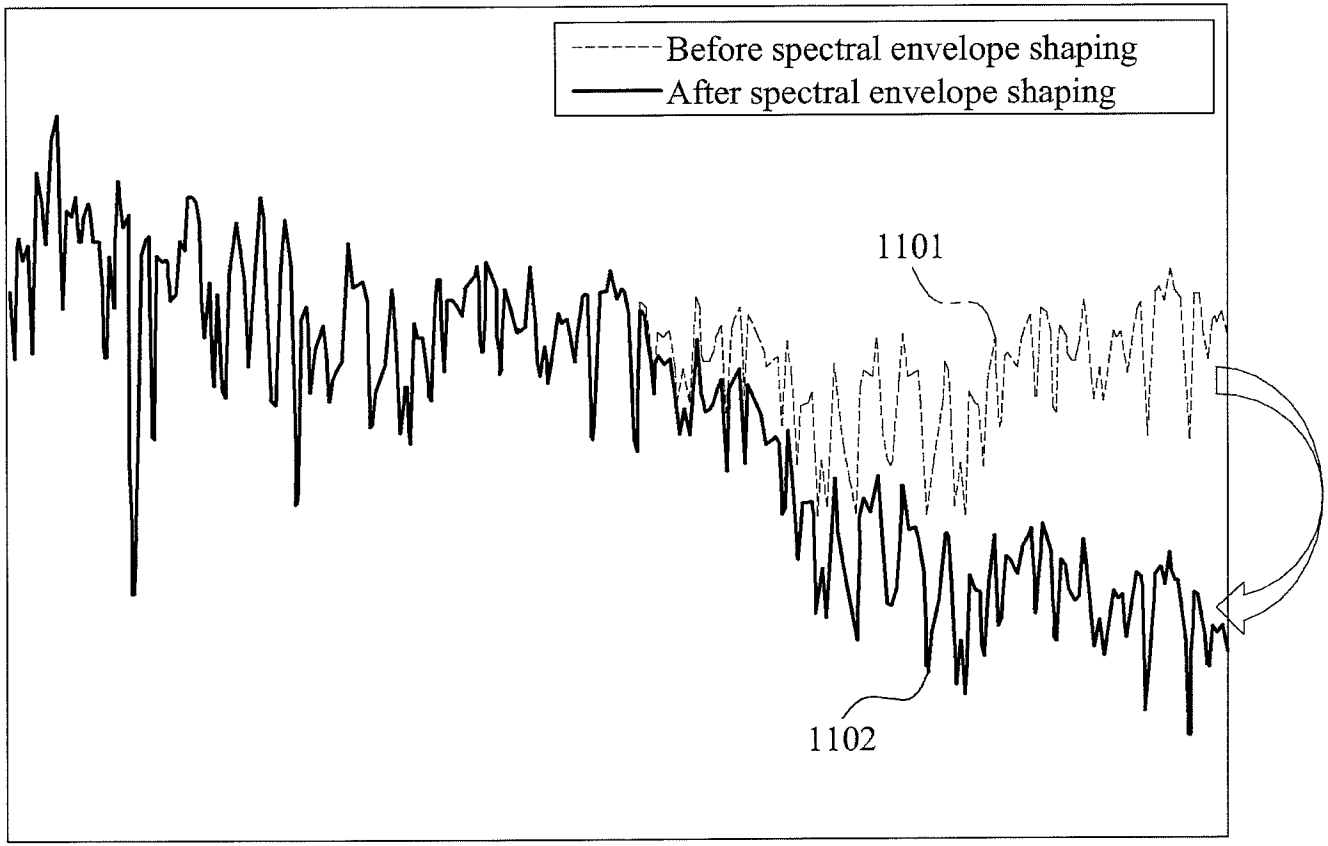
FIG. 11 illustrating a result of an adjusting of an envelope of a high frequency band, according to one or more embodiments.

FIG. 11 illustrates a result of an adjusting of an envelope of a high frequency band, according to one or more embodiments.

That is, FIG. 11 shows a result of a shaping operation, where an envelope of a restored high frequency band is adjusted. The graph 1101 shows a state before the shaping of the envelope, while the graph 1102 shows a result of the shaping of the envelope. The shaping of the envelope may refer to applying an envelope trend of the low frequency band to the envelope of the high frequency band.

Thus, referring to FIG. 11, at this time the envelope of the high frequency band may also be reduced corresponding to a tilt of the envelope of the low frequency band. The envelope of the high frequency band may be adjusted by using the below Equation 7, as only an example.

$$H(m,k+f_{cut_off})=H(m,k+f_{cut_off})v_k(\gamma),\ k=0,\ldots f_{max}-f_{cut_off} \qquad \text{Equation 7:}$$

Here, fcut_off may denote a cutoff frequency, fmax may denote a maximum frequency, and vk may denote an envelope generated based on an optimal tilt of the envelope of the low frequency band.

Thus, according to the one or more embodiments, clarity of a sound source may be increased by restoring the signal of the high frequency band from the signal of the low frequency band.

According to the one or more embodiments, the signal of the high frequency band may be restored by sequential folding in units of frequency sub-bands beginning near a cutoff frequency, so audibility of the discontinuity at the cutoff frequency may be reduced. Also, harmonic noise at the low frequency band may be reduced.

According to the one or more embodiments, a restored signal of the high frequency band may be adjusted depending on a tilt of an envelope of the low frequency band. Therefore, reduction in sound quality caused by incorrectly recovered signals of the high frequency band may be prevented.

Figure 12:
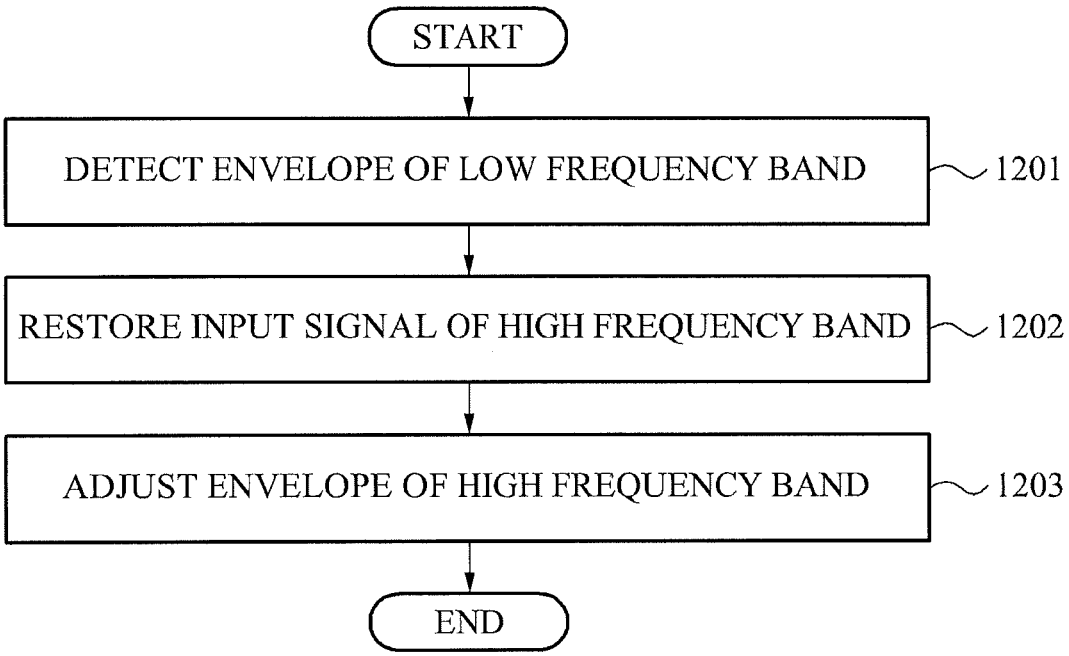
FIG. 12 illustrates a process of the sound quality enhancement method, according to one or more embodiments.

FIG. 12 illustrates a sound quality enhancement method, according to one or more embodiments.

In operation 1201, the sound quality enhancement apparatus may detect an envelope of a low frequency band signal, e.g., the decoded or resampled low frequency band signal. As only an example, the sound quality enhancement apparatus may extract the envelope of the low frequency band signal using a determined energy per frequency sub-band of the low frequency band signal. Here, the sound quality enhancement apparatus may further perform flattening with respect to an envelope change degree by smoothing a tilt of the envelope from the low frequency band to be applied to the high frequency band, along a time axis.

In operation 1202, the sound quality enhancement apparatus may restore the input signal of the high frequency band using a detected envelope of a sub-band of the low frequency band adjacent to the cutoff frequency. As only an example, the sound quality enhancement apparatus may restore the input signal of the high frequency band by performing frequency folding, i.e., mirror imaging a signal or a sub-band portion of the signal so low and high frequencies are transposed about a frequency, in units of a frequency sub-band along the envelope for the high frequency band. That is, the sound quality enhancement apparatus may generate a signal corresponding to a current frequency sub-band for the high frequency band by folding, i.e., mirror imaging, the signal corresponding to a frequency-wise previous frequency sub-band. Here, when the current frequency sub-band is a first frequency sub-band of the high frequency band, the sound quality enhancement apparatus may generate the signal corresponding to the current frequency sub-band by folding the signal corresponding to the previous low frequency sub-band. In addition, the sound quality enhancement apparatus may perform flattening of an envelope corresponding to the current frequency sub-band by considering whether an envelope corresponding to the previous generated frequency sub-band is flat.

In operation 1203, the sound quality enhancement apparatus may adjust an envelope corresponding to the restored high frequency band by considering a tilt of the envelope corresponding to the low frequency band of the input signal.

In one or more embodiments, any apparatus, system, and unit descriptions herein include one or more hardware devices or hardware processing elements. For example, in one or more embodiments, any described apparatus, system, and unit may further include one or more desirable memories, and any desired hardware input/output transmission devices. Further, the term apparatus should be considered synonymous with elements of a physical system, not limited to a single device or enclosure or all described elements embodied in single enclosures in all embodiments, but rather, depending on embodiment, is open to being embodied together or separately in differing enclosures and/or locations through differing hardware elements.

In addition to the above described embodiments, embodiments can also be implemented through computer readable code/instructions in/on a non-transitory medium, e.g., a computer readable medium, to control at least one processing device, such as a processor or computer, to implement any above described embodiment. The medium can correspond to any defined, measurable, and tangible structure permitting the storing and/or transmission of the computer readable code.

The media may also include, e.g., in combination with the computer readable code, data files, data structures, and the like. One or more embodiments of computer-readable media include: magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. Computer readable code may include both machine code, such as produced by a compiler, and files containing higher level code that may be executed by the computer using an interpreter, for example. The media may also be any defined, measurable, and tangible distributed network, so that the computer readable code is stored and executed in a distributed fashion. Still further, as only an example, the processing element could include a processor or a computer processor, and processing elements may be distributed and/or included in a single device.

The computer-readable media may also be embodied in at least one application specific integrated circuit (ASIC) or Field Programmable Gate Array (FPGA), as only examples, which execute (processes like a processor) program instructions.

While aspects of the present invention has been particularly shown and described with reference to differing embodiments thereof, it should be understood that these embodiments should be considered in a descriptive sense only and not for purposes of limitation. Descriptions of features or aspects within each embodiment should typically be considered as available for other similar features or aspects in the remaining embodiments. Suitable results may equally be achieved if the described techniques are performed in a different order and/or if components in a described system, architecture, device, or circuit are combined in a different manner and/or replaced or supplemented by other components or their equivalents.

Thus, although a few embodiments have been shown and described, with additional embodiments being equally available, it would be appreciated by those skilled in the art that changes may be made in these embodiments without departing from the principles and spirit of the invention, the scope of which is defined in the claims and their equivalents.

What is claimed is:

1. An audio processing apparatus comprising:

at least one processor; and a memory having instructions stored thereon executed by the at least one processor to perform:

detecting an envelope of an input signal with respect to a low frequency band of the input signal; and restoring a high frequency band of the input signal by performing frequency folding based on the detected envelope, wherein the restoring of the high frequency band comprises selectively performing flattening an envelope corresponding to a current frequency sub-band based on a determination of whether an envelope corresponding to a previous frequency sub-band is flattened.

2. The audio processing apparatus of claim 1, wherein the detecting of the envelope comprises extracting the envelope, using respective energies per frequency sub-band of the input signal.

3. The audio processing apparatus of claim 2, wherein the detecting of the envelope comprises smoothing a tilt of the envelope along a time axis for the high frequency band, thereby performing flattening with respect to a temporal change degree of the envelope.

4. The audio processing apparatus of claim 1, wherein the restoring of the high frequency band comprises restoring a signal corresponding to the current frequency sub-band by folding a signal corresponding to a frequency-wise previous frequency sub-band of the input signal into the current frequency sub-band.

5. The audio processing apparatus of claim 4, wherein the restoring of the high frequency band comprises restoring the signal corresponding to the current frequency sub-band by folding the signal corresponding to the previous frequency sub-band, as included in the low frequency band, into the current frequency sub-band when the current frequency sub-band is a first frequency sub-band of the high frequency band.

6. The audio processing apparatus of claim 1, wherein the restoring of the high frequency band comprises selectively performing the flattening with respect to the envelope corresponding to the current frequency sub-band based upon a determination of whether an alterable flattening indicator indicates that the previous frequency sub-band was flattened.

7. The audio processing apparatus of claim 6, wherein, based on whether flattening is performed on the envelope of the current frequency sub-band, an alterable flattening indicator for the current frequency sub-band is controlled to indicate that the flattening is performed on the envelope of the current frequency sub-band.

8. The audio processing apparatus of claim 1, wherein the memory has instructions stored thereon executed by the at least one processor to further perform adjusting an envelope corresponding to the restored high frequency band by considering a tilt of an envelope corresponding to the low frequency band of the input signal.

9. The audio processing apparatus of claim 8, wherein the adjusting of the envelope corresponding to the restored high frequency band is performed after all frequency folding has been performed for a current frame of the input signal.

10. The audio processing apparatus of claim 1, wherein the low frequency band corresponds to frequencies before a cutoff frequency and the high frequency band corresponds to frequencies after the cutoff frequency.

11. The audio processing apparatus of claim 1, wherein the memory has instructions stored thereon executed by the at least one processor to further perform decoding of the input signal from a compressed input signal encoded with a low bit rate or low sampling rate.

12. An audio processing apparatus comprising:

at least one processor; and a memory having instructions stored thereon executed by the at least one processor to perform:

detecting an envelope of an input signal with respect to a low frequency band of the input signal;

restoring a high frequency band of the input signal using a detected envelope of a sub-band of the low frequency band, adjacent to a cutoff frequency, from the detected envelope of the input signal; and adjusting an envelope of the high frequency band based on a tilt of the envelope of the low frequency band, wherein the tilt of the envelope of the low frequency band is an optimal tilt of the envelope of the low frequency band, the optimal tilt of the envelope of the low frequency band being calculated using an exponential function.

13. The audio processing apparatus of claim 12, wherein the detecting of the envelop comprises detecting the envelope of the sub-band of the low frequency band.

14. The audio processing apparatus of claim 12, wherein the restoring of the high frequency band comprises restoring the high frequency band by performing sequential folding of already restored frequency sub-bands of the high frequency band into respective current sub-bands of the high frequency band.

15. The audio processing apparatus of claim 14, wherein the restoring of the high frequency band comprises performing flattening of an envelope of a frequency sub-band of the input signal based on whether an envelope of a frequency-wise previous frequency sub-band of the input signal was flattened.

16. An audio processing method comprising:

detecting an envelope of an input signal with respect to a low frequency band of the input signal; and restoring a high frequency band of the input signal by performing frequency folding in based on the detected envelope, wherein the restoring comprises selectively performing flattening an envelope corresponding to a current frequency sub-band using a tilt of the detected envelope, wherein the restoring of the high frequency band comprises selectively performing flattening an envelope corresponding to a current frequency sub-band based on a determination of whether an envelope corresponding to a previous frequency sub-band is flattened.

17. The audio processing method of claim 16, wherein the detecting of the envelope further comprises:

extracting the envelope of the input signal, using respective energies per frequency sub-band of the input signal.

18. The audio processing method of claim 17, wherein the detecting of the envelope further comprises performing flattening of the envelope, for restoring the high frequency band, with respect to a temporal change degree of the envelope by smoothing a tilt of the envelope along a time axis.

19. The audio processing method of claim 16, wherein the restoring of the input signal of the high frequency band comprises restoring a signal corresponding to the current frequency sub-band by folding a signal corresponding to a frequency-wise previous frequency sub-band of the input signal into the current frequency sub-band of the high frequency band.

20. The audio processing method of claim 19, wherein the restoring of the input signal of the high frequency band comprises restoring the signal corresponding to the current frequency sub-band by folding the signal corresponding to the previous frequency sub-band, as included in the low frequency band, into the current frequency sub-band when the current frequency sub-band is a first frequency sub-band of the high frequency band.

21. The audio processing method of claim 16, wherein the selective performing is based upon a determination of whether an alterable flattening indicator indicates that the previous frequency sub-band was flattened.

22. The audio processing method of claim 21, wherein, based on whether flattening is performed on the envelope of the current frequency sub-band, controlling an alterable flattening indicator for the current frequency sub-band to indicate that the flattening is performed on the envelope of the current frequency sub-band.

23. The audio processing method of claim 16, further comprising adjusting an envelope corresponding to the restored high frequency band by considering a tilt of an envelope corresponding to the low frequency band of the input signal.

24. The audio processing method of claim 23, where the adjusting of the envelope corresponding to the restored high frequency band is performed after all frequency folding has been performed for a current frame of the input signal.

25. The audio processing method of claim 16, wherein the low frequency band corresponds to frequencies before a cutoff frequency and the high frequency band corresponds to frequencies after the cutoff frequency.

26. The audio processing method of claim 16, further comprising decoding the input signal from a compressed input signal encoded with a low bit rate or low sampling rate.

27. An audio processing method comprising: detecting an envelope of an input signal with respect to a low frequency band of the input signal; restoring a high frequency band of the input signal using a detected envelope of a sub-band of a low frequency band, adjacent to a cutoff frequency, from the detected envelope of the input signal; and adjusting an envelope of the high frequency band based on a tilt of the envelope of the low frequency band, wherein the tilt of the envelope of the low frequency band is an optimal tilt of the envelope of the low frequency band, the optimal tilt of the envelope of the low frequency band being calculated using an exponential function.

28. The audio processing method of claim 27, wherein the detecting of the envelope of the low frequency band comprises detecting the envelope of the sub-band of the low frequency band.

29. The audio processing method of claim 27, wherein the restoring of the high frequency band further comprises restoring the high frequency band of the input signal by performing sequential folding of already restored frequency sub-bands of the high frequency band into respective current sub-bands of the high frequency band.

30. The audio processing method of claim 27, wherein the restoring of the high frequency band further comprises performing flattening of an envelope of a frequency sub-band based on whether an envelope of a frequency-wise previous frequency sub-band of the input signal was flattened.

31. A non-transitory computer readable recording medium comprising computer readable code to control at least one processing device to implement the method of claim 16.

* * * * *